US006045409A

United States Patent [19]

Abe

[11] Patent Number: 6,045,409

[45] Date of Patent: Apr. 4, 2000

[54] PRESS-CONNECTING CONNECTOR

[75] Inventor: Kimihiro Abe, Shizuoka, Japan

[73] Assignee: Yazaki Corporation, Tokyo, Japan

[21] Appl. No.: 09/038,824

[22] Filed: Mar. 12, 1998

[30] Foreign Application Priority Data

Mar. 13, 1997 [JP] Japan ..... 9-059629

[51] Int. Cl.[7] ..... H01R 13/502

[52] U.S. Cl. ..... 439/701

[58] Field of Search ..... 439/594, 595, 439/701, 717

[56] References Cited

FOREIGN PATENT DOCUMENTS 6-54214 7/1994 Japan .

*Primary Examiner*—Khiem Nguyen

*Attorney, Agent, or Firm*—Morgan, Lewis & Bockius LLP

[57] ABSTRACT

A press-connecting connector in which the press-connection of a plurality of rows of wires, arranged in a vertical direction, can be easily effected, and sufficient rigidity of a fitting hood portion at its open side is obtained. A plurality of connector housings are stacked together, and the connector housings have a fitting hood portion, and also have wire press-connecting openings, respectively, and press-connecting terminals are mounted in each of the connector housings in such a manner that the terminals are exposed through the opening, and extend into the fitting hood portion, and wires are adapted to be press-connected respectively to the press-connecting terminals. One of the plurality of connector housings has a common hood portion which is also used as a part of the other connector housing. The common hood portion of the one connector housing cooperates with a hood portion of the other connector housing to form the fitting hood portion.

5 Claims, 5 Drawing Sheets

PRESS-CONNECTING CONNECTOR

BACKGROUND OF THE INVENTION

1. Field of the Invention

This invention relates to a press-connecting connector which is suitably used in a wire harness for an automobile or the like.

2. Background

One conventional press-connecting connector will be specifically described with reference to FIGS. 5 to 7. A male press-connecting connector 1 includes a flattened, tubular connector case 2 of a square cross-section having a front portion defining a fitting hood portion 2*a* for receiving a female connector (not shown). Terminal holding portions 2*b* are formed in a base portion of the connector case, and extend therethrough in a forward-rearward direction, and a plurality of press-connecting terminals 3 are held respectively in these terminal holding portions 2*b*. Press-connecting slots 3*b* of press-connecting portions 3*a* of the press-connecting terminals 3 are exposed through an opening 2*c* formed in the connector case 2, and wires W are press fitted respectively into the press-connecting slots 3*b*, and thus are press-connected to the press-connecting terminals 3, respectively. The press-connected portions of the wires W are covered with a cover 4. FIG. 8 shows a male press-connecting connector 1' in which upper and lower rows of press-connecting terminals 3 are arranged back to back in a connector case 2.

In the above conventional press-connecting connector 1', two rows of wires, arranged in a vertical direction, can be press-connected respectively to the upper and lower rows of press-connecting terminals 3 held in the upper and lower terminal holding portions 2*b*. Further, in the above conventional press-connecting connector 1', the press-connecting slots 3*b* of the upper rows of the press-connecting terminals 3 and the press-connecting slots 3*b* of the lower rows of the press-connecting terminals 3 face respectively in opposite directions, that is, the upper and lower rows of the press-connecting terminals 3 are arranged back to back. However, when the press-connecting slots of the rows of press-connecting terminals need face in the same direction in relation to the arrangement of terminal spring contact portions of a female connector to be fitted in a fitting hood portion 2*a*, the press-connecting connector 1' can not be used.

SUMMARY OF THE INVENTION

This invention seeks to overcome the above problem, and an object of the invention is to provide a press-connecting connector in which the press-connection of a plurality of rows of press-connecting terminals, arranged in a vertical direction, can be easily effected, and the connector has a fitting hood portion which enables a plurality of rows of press-connecting terminals, held in a vertical direction, to face in the same direction.

According to the invention, there is provided a press-connecting connector in which a plurality of connector housings are stacked together, the connector housings have a fitting hood portion and respectively have wire press-connecting openings, press-connecting terminals are mounted in the connector housings in such a manner that the terminals are exposed through the wire press-connecting openings, and extend into the fitting hood portion, wires are adapted to be press-connected respectively to the press-connecting terminals, the wire press-connecting openings are formed respectively in the connector housings so as to be arranged to face in the same direction, and slots, which are formed respectively in press-connecting portions of the press-connecting terminals in the connector housings, and are exposed through the wire press-connecting openings, face in the same direction.

In the press-connecting connector, the press-connection of the wires, arranged in vertical rows, can be easily effected. And besides, the plurality of rows of the press-connecting terminals are arranged in the same direction.

According to the invention, there is provided a press-connecting connector in which a plurality of connector housings are stacked together, the connector housings have a fitting hood portion and respectively have wire press-connecting openings, press-connecting terminals are mounted in the connector housings in such a manner that the terminals are exposed through the wire press-connecting openings, and extend into the fitting hood portion, and wires are adapted to be press-connected respectively to the press-connecting terminals; in which one of the plurality of connector housings has a common hood portion which is used as a part of the other connector housings.

In this press-connecting connector, the sufficient rigidity of the hood portion of each of the connector housings at its open side is obtained.

In the press-connecting connector of the invention, the common hood portion of the one connector housing cooperates with hood portions of the other connector housings to form the fitting hood portion.

In this press-connecting connector, the sufficient rigidity of the fitting hood portion at its open side is obtained.

In the press-connecting connector of the invention, the plurality of connector housings are upper and lower connector housings, and the lower connector housing has the common hood portion.

In this press-connecting connector, the common hood portion of the lower connector housing positively prevents terminal portions of the press-connecting terminals, received within the fitting hood portion, from being deformed.

DETAILED DESCRIPTION OF THE PREFERRED EMBODIMENT

Figure 1:
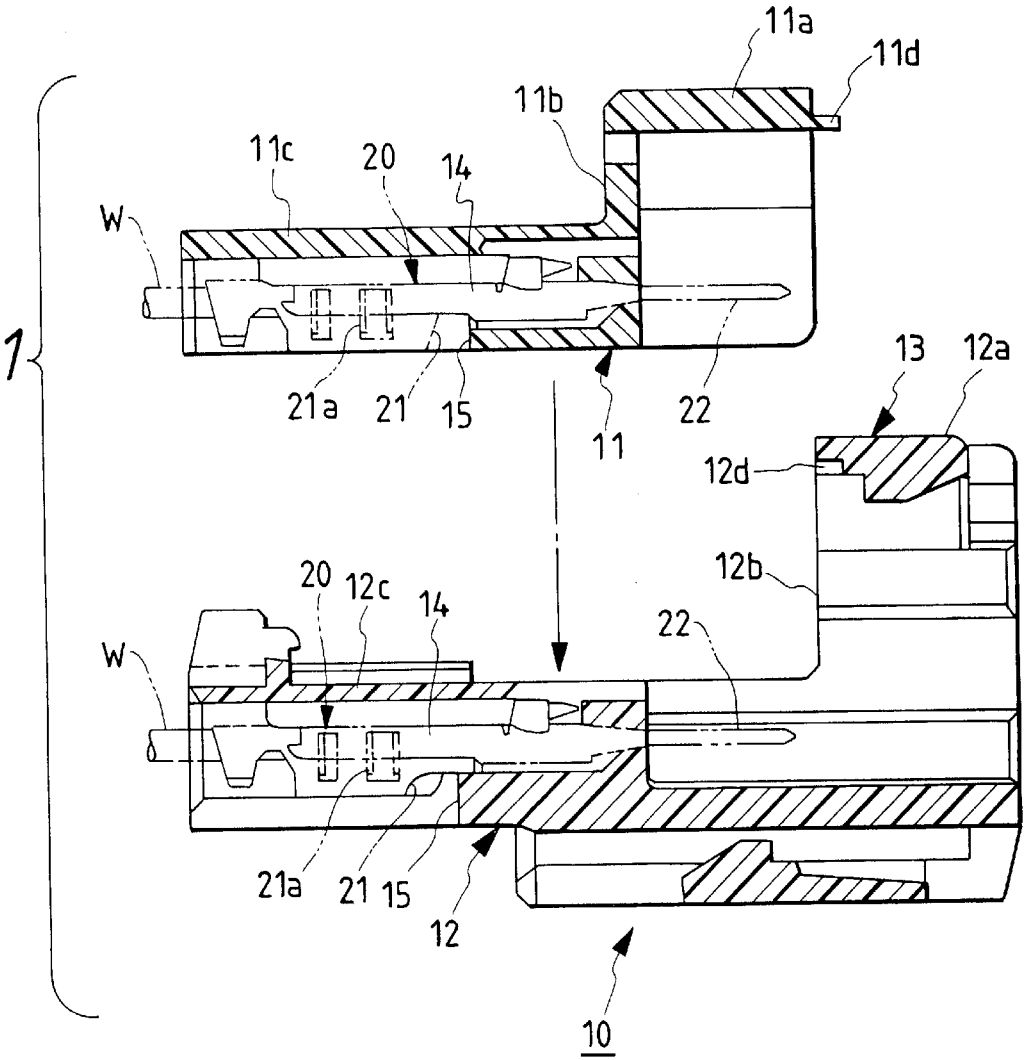
FIG. 1 is a cross-sectional view of one preferred embodiment of a split-type press-connecting connector of the invention, showing a condition in which upper and lower connector housings are separated from each other.

One preferred embodiment of the present invention will now be described with reference to the drawings.

FIGS. 1 to 4 show one preferred embodiment of a split-type male press-connecting connector. The split-type press-connecting connector 10 comprises an upper connector housing 11 of a synthetic resin, and a lower connector housing 12 of a synthetic resin with which the upper connector housing 11 is combined. The upper and lower connector housings 11 and 12 are so designed that they, when combined together, assume a tubular configuration of a square cross-section. A common hood portion 12*a* of an L-shape is formed integrally at a front portion of the lower connector housing 12, and serves as a part of a fitting hood portion of the upper connector housing 11. A notched portion 12*b* is formed in a rear side of the common hood portion 12*a*. A hood portion 11*a* is formed integrally at a front portion of the upper connector housing 11. The hood portion 11*a* is adapted to be mated with the notched portion 12*b*. The common hood portion 12*a* of the lower connector housing 12 and the hood portion 11*a* of the upper connector housing 11 cooperate with each other to form a fitting hood portion 13 of the split-type press-connecting connector 10.

Figure 2:
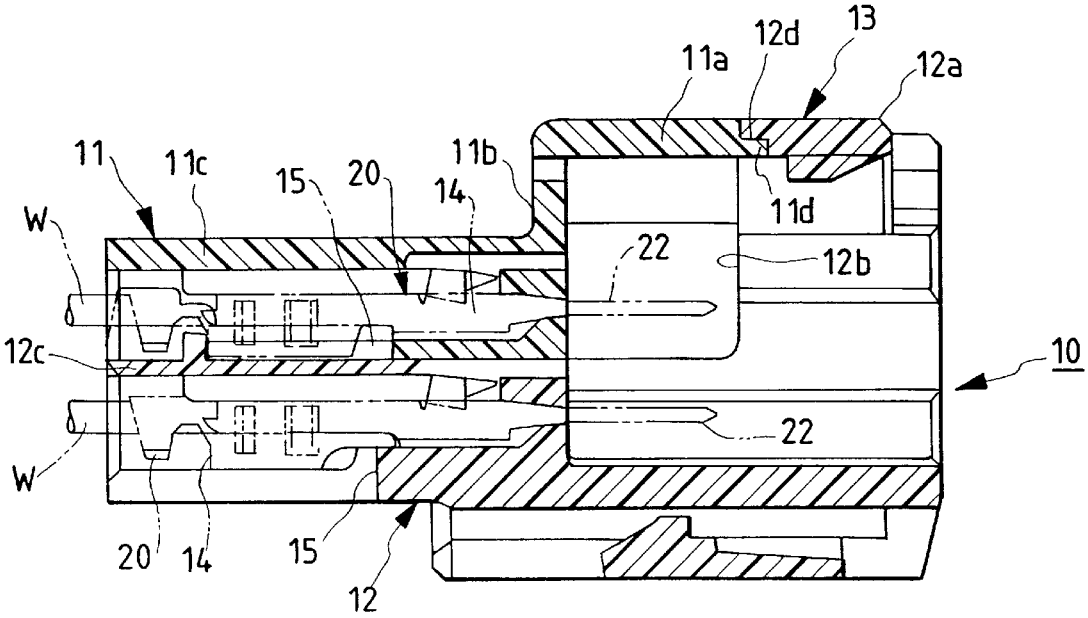
FIG. 2 is a cross-sectional view of the split-type press-connecting connector, showing a condition in which the upper and lower connector housings are combined together.
Figure 3:
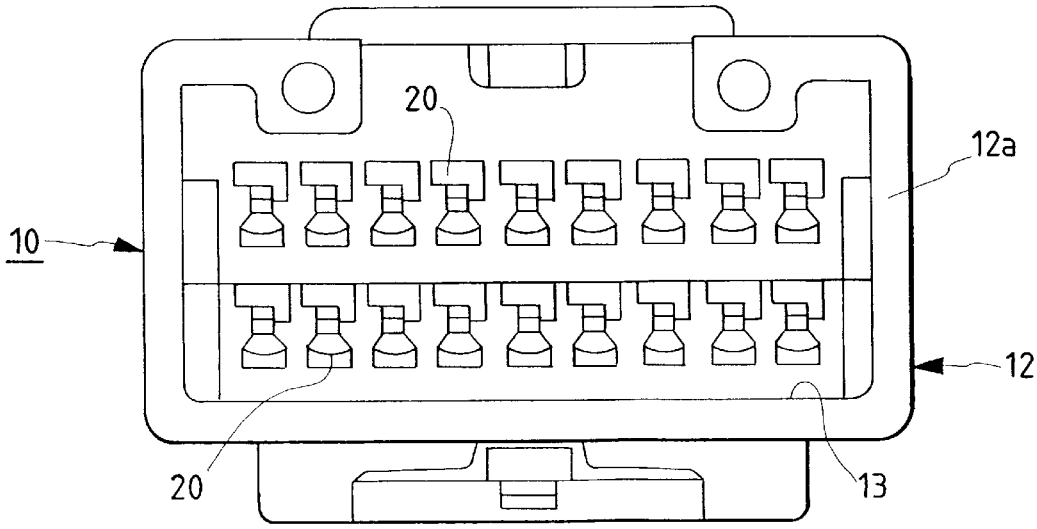
FIG. 3 is a front-elevational view of the split-type press-connecting connector as seen from a fitting hood portion side.

Terminal holding portions 14 are formed in a base portion 11*c* of the upper connector housing 11, and terminal holding portions 14 are formed in a base portion 12*c* of the lower connector housing 12, and a plurality of press-connecting terminals 20 are held respectively in these terminal holding portions 14. A wire press-connecting opening 15 is formed in the lower side of rear portions of the terminal holding portions 14 formed in each of the upper and lower connector housings 11 and 12. The press-connecting terminals 20 are mounted respectively in each of the upper and lower connector housings 11 and 12 in such a manner that the terminals 20 are exposed through the opening 15, and extend into the fitting hood portion 13. A row of wires W are press-connected respectively to the press-connecting terminals 20 mounted in each of the upper and lower connector housings 11 and 12. The rows of wires W being adapted to be arranged in a vertical direction. The wire press-connecting openings 15 and 15, formed respectively in the upper and lower connector housings 11 and 12, are arranged to face in the same direction. Further, slots 21*a* are formed respectively in press-connecting portions 21 of the press-connecting terminals 20 in the upper connector housing 11, and are exposed through the opening 15. Also, slots 21*a* are formed respectively in press-connecting portions 21 of the press-connecting terminals 20 in the lower connector housing 12, and are exposed through the opening 15. The slots 21*a* of the press-connecting terminals 20 in the upper connector housing 11 and the slots 21*a* of the press-connecting terminals 20 in the lower connector housing 12 face in the same direction. Therefore, as shown in FIGS. 2 and 3, juxtaposed tabs (male terminal portions) 22 of the press-connecting terminals 20 are arranged in upper and lower rows within the fitting hood portion 13.

Figure 4:
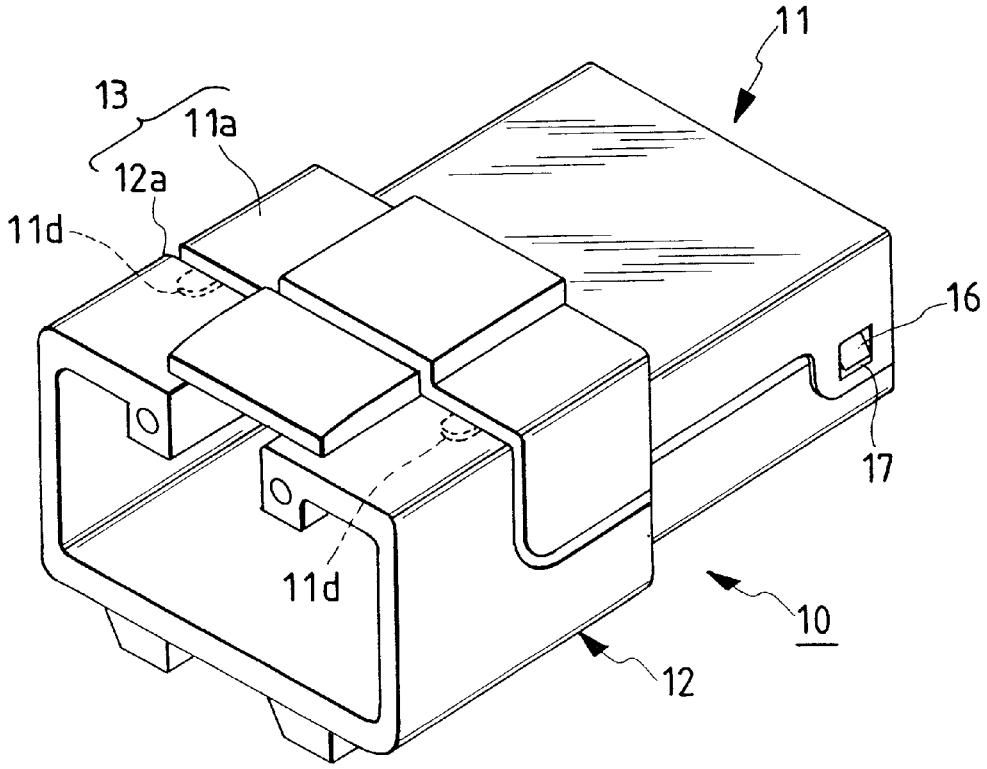
FIG. 4 is a perspective view of the split-type press-connecting connector.
Figure 6:
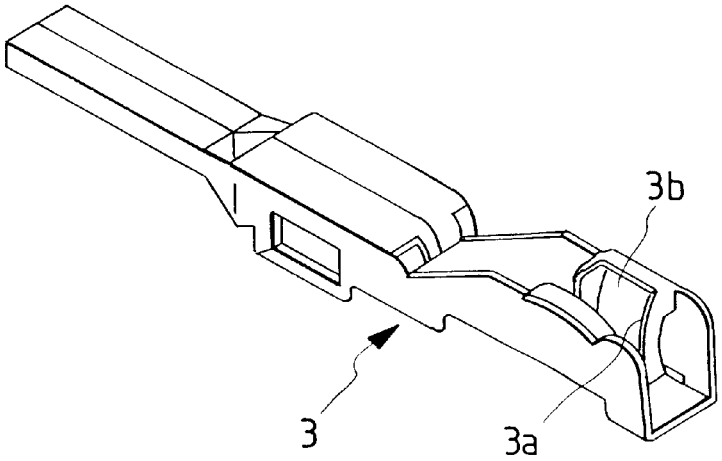
FIG. 6 PRIOR ART
FIG. 6 is an enlarged, perspective view of a press-connecting terminal used in the conventional press-connecting connector in FIG. 5.
Figure 5:
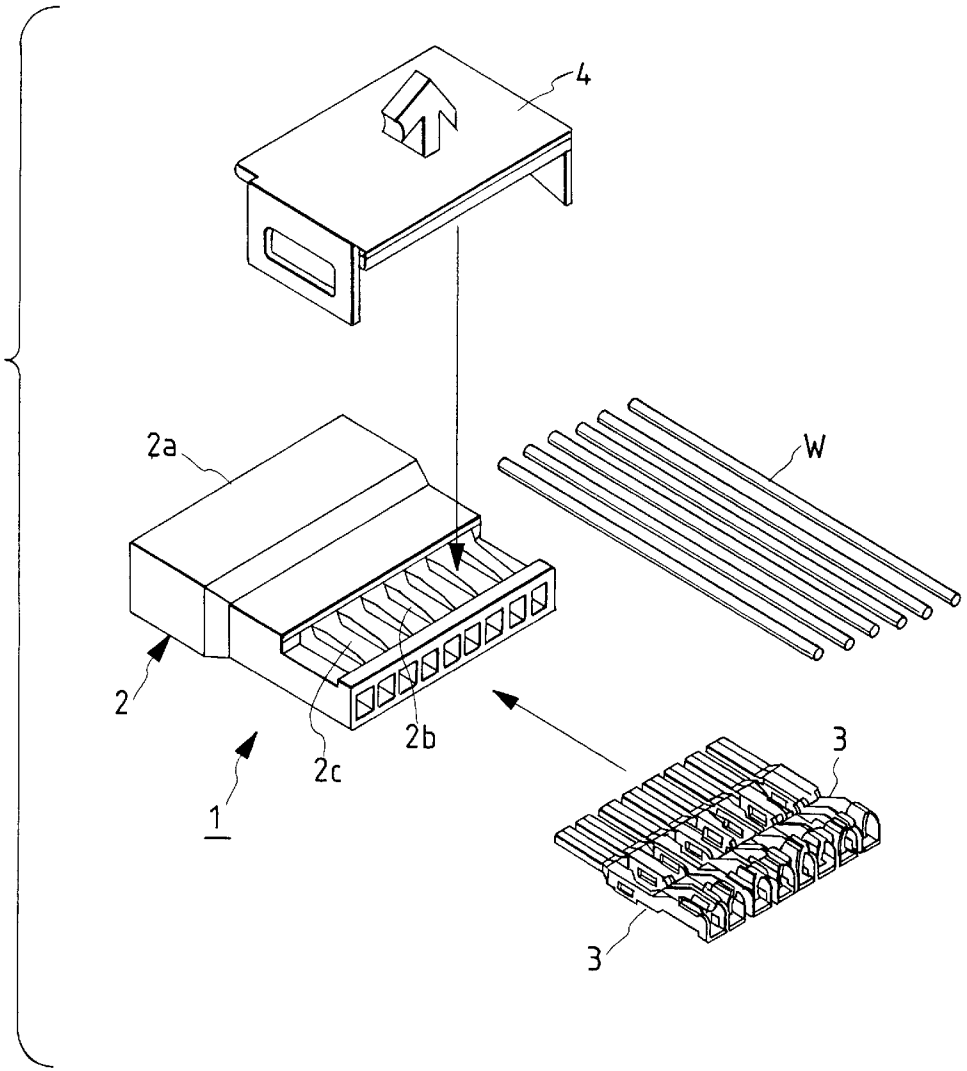
PRIOR ART FIG. 5
FIG. 5 is a perspective view of a conventional press-connecting connector, showing a state before the press-connecting connector has not been assembled yet.
Figure 7:
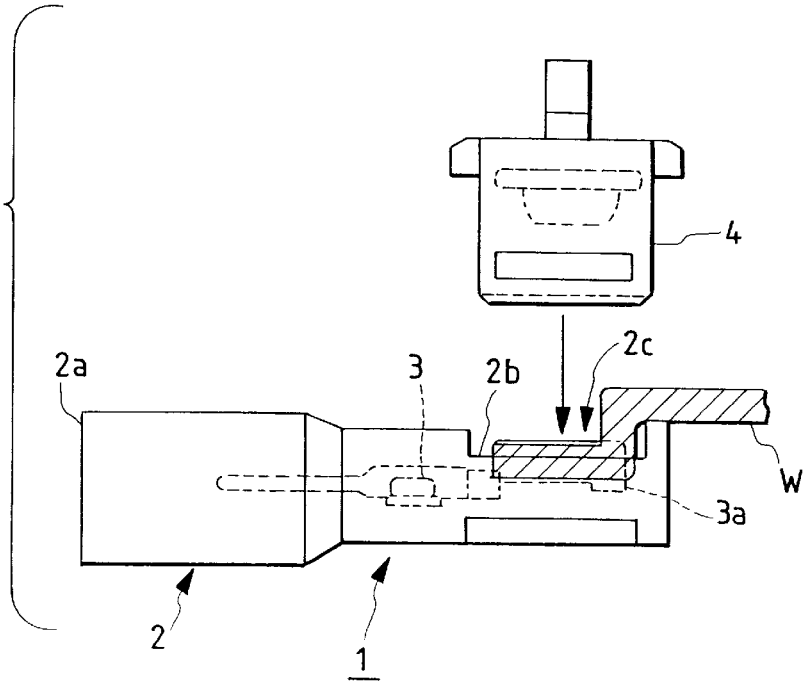
PRIOR ART FIG. 7
FIG. 7 is a side-elevational view of the above conventional press-connecting connector, showing the manner of press-connecting wires.
Figure 8:
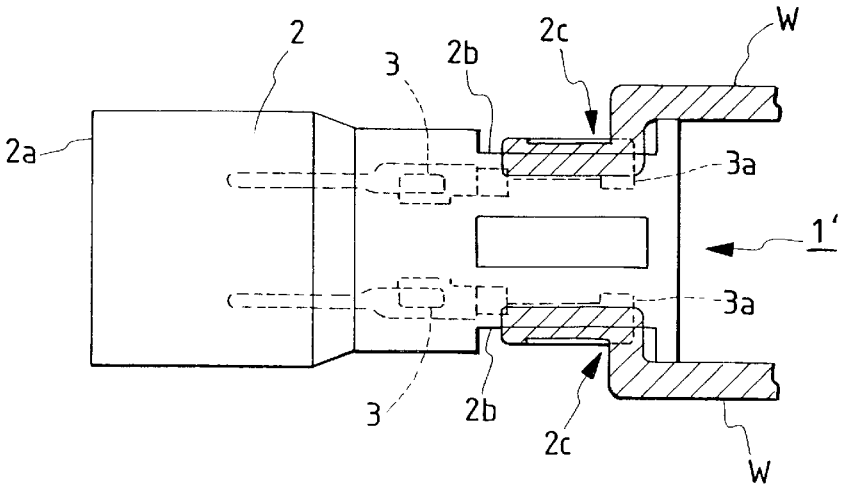
FIG. 8 is a side-elevational view of a split-type press-connecting connector formed using the two conventional press-connecting connectors.

As shown in FIG. 4, a pair of retaining pawls (retaining portions) 16 and 16 are integrally formed respectively on rear end portions of opposite side walls of the lower connector housing 12, and a pair of rectangular engagement holes (engagement portions) 17 and 17, corresponding respectively to the retaining pawls 16, are formed respectively through opposite side walls of the upper connector housing 11. By engaging the retaining pawls 16 respectively in the engagement holes 17, the upper and lower connector housings 11 and 12, combined together, can be releasably locked to each other. At this time, a pair of claws (retaining portions) 11*d* and 11*d*, formed on an upper front edge of the hood portion 11*a* of the upper connector housing 11, are engaged respectively in a pair of recesses (engagement portions) 12*d* and 12*d* formed in an upper rear edge of the common hood portion 12*a* of the lower connector housing 12. The opening 15, provided rearwardly of the common hood portion 12*a* of the lower connector housing 12, is adapted to be closed by a cover (not shown).

In a split condition (FIG. 1) of the split-type press-connecting connector 10 of this embodiment, the wires W are press-connected respectively to the slots 21*a* of the press-connecting portions 21 of the press-connecting terminals 20, mounted respectively in the terminal holding portions 14 of the upper connector housing 11, through the wire press-connecting opening 15, using a predetermined jig. Similarly, the wires W are press-connected to the lower connector housing 12. Thereafter, the two connector housings 11 and 12 are combined together to form the split-type press-connecting connector 10.

In this split-type press-connecting connector 10, the lower connector housing 12 has the common hood portion 12*a* which serves also as a part of the hood portion of the upper connector housing 11, and the common hood portion 12*a* cooperates with the hood portion 11*a* of the upper connector housing 11 to form the fitting hood portion 13. Therefore, the sufficient rigidity of the fitting hood portion 13 at its open side is obtained, and the connector can be handled easily. The wire press-connecting openings 15, formed respectively in the two connector housings 11 and 12, are arranged to face in the same direction, and also, the slots 21*a*, which are formed respectively in the press-connecting portions 21 of the press-connecting terminals 20 in the upper connector housing 11, are exposed through the opening 15, and the slots 21*a*, which are formed respectively in press-connecting portions 21 of the press-connecting terminals 20 in the lower connector housing 12, and are exposed through the opening 15, face in the same direction. Therefore, the upper and lower rows of wires W can be easily press-connected to the respective press-connecting terminals, and also this arrangement meets the requirement of a female connector to be fitted into the fitting hood portion 13. And besides, the upper connector housing 11 and the common hood portion 12*a* of the lower connector housing 12 positively prevent the tabs 22 of the press-connecting terminals 20, received within the fitting hood portion 13, from being deformed.

In the above embodiment, although the split-type press-connecting connector having the male terminals has been described above, the invention can be applied to the connector having female terminals.

As described above, in the press-connecting connector of the invention, the wire press-connecting openings, formed respectively in the plurality of connector housings, are arranged to face in the same direction, and the slots, which are formed respectively in the press-connecting portions of the press-connecting terminals in the plurality of connector housings, and are exposed through the openings, face in the same direction. With this construction, the press-connection of the wires, arranged in vertical rows, can be easily effected. And besides, the plurality of rows of wires are arranged in the same direction, thereby enhancing the versatility.

In the press-connecting connector of the invention, one of the plurality of connector housings has the common hood portion which is also used as a part of the other connector housings. With this construction, the sufficient rigidity of the hood portion of each of the connector housings at its open side is obtained, and the connector can be easily handled.

In the press-connecting connector of the invention, the common hood portion of the one connector housing cooperates with hood portions of the other connector housings to form the fitting hood portion. With this construction, the sufficient rigidity of the fitting hood portion at its open side is obtained, and the connector can be easily handled.

In the press-connecting connector of the invention, the plurality of connector housings are upper and lower connector housings, and the lower connector housing has the common hood portion. With this construction, the common hood portion of the lower connector housing positively prevents the terminal portions of the press-connecting terminals, received within the fitting hood portion, from being deformed.

What is claimed is:

1. A connector, comprising:

a first housing having a first terminal receiving chamber into which a first press-connecting terminal having a contact portion and a press-connecting portion is insertable, a first opening through which the first press-connecting terminal is partially exposed, wherein a wire is adapted to be press-connected to the press-connecting portion of the first press-connecting terminal through the first opening, and a first hood portion formed integrally with the first housing and into which the contact portion of the first press-connecting terminal is extended; and a second housing, on which the first housing is stackable, having a second terminal receiving chamber into which a second press-connecting terminal having a contact portion and a press-connecting portion is insertable, a second opening through which the second press-connecting terminal is partially exposed, wherein a wire is adapted to be press-connected to the press-connecting portion of the second press-connecting terminal through the second opening, and a second hood portion formed integrally with the second housing and into which the contact portion of the second press-connecting terminal is extended, wherein when the first housing is stacked on the second housing, the first opening and the second opening are arranged to face in the same direction, and the press-connecting portion of the first press-connecting terminal and the press-connecting portion of the second press-connecting terminal face in the same direction with the first hood portion used in common with the second hood portion and cooperating with the second hood portion to form a fitting portion for mating with another connector.

2. The connector of claim 1, wherein the first housing is an upper housing and the second housing is a lower housing.

3. A connector, comprising:

a plurality of housings stackable together, the housings having terminal receiving chambers into which press-connecting terminals are insertable respectively, and openings through which the press-connecting terminals are partially exposed, wherein wires are adapted to be press-connected to the press-connecting terminals through the openings;

a fitting hood portion, into which contact portions of the press-connecting terminals are extended, formed integrally with portions of the housings when the housings are stacked; and a common hood portion formed integrally with one of the housings, the common hood portion cooperating with a portion of another one of the housings to form said fitting hood portion.

4. The connector of claim 3, wherein when the housings are stacked, the openings are arranged to face in the same direction, and slots, which are formed respectively in press-connecting portions of the press-connecting terminals in the terminal receiving chambers, and are exposed through the openings, face in the same direction.

5. The connector of claim 3, wherein the housings are upper and lower housings, and the lower housing has the common hood portion.

* * * * *